US006127983A

United States Patent [19]

Rivera et al.

[11] Patent Number: 6,127,983

[45] Date of Patent: Oct. 3, 2000

[54] WIDEBAND ANTENNA FOR TOWED LOW-PROFILE SUBMARINE BUOY

[75] Inventors: David F. Rivera, Higganum; Michael J. Josypenko, Norwich, both of Conn.

[73] Assignee: The United States of America as represented by the Secretary of the Navy, Washington, D.C.

[21] Appl. No.: 09/173,610

[22] Filed: Oct. 8, 1998

[51] Int. Cl.[7] ..... H01Q 1/32

[52] U.S. Cl. ..... 343/767; 343/770; 343/709

[58] Field of Search ..... 343/767, 709, 343/768, 770, 771

[56] References Cited

U.S. PATENT DOCUMENTS 2,555,443 6/1951 Harvey ..... 343/767

5,850,198 12/1998 Lindenmeier et al. ..... 343/713

*Primary Examiner*—Don Wong
*Assistant Examiner*—James Clinger
*Attorney, Agent, or Firm*—Michael J. McGowan; Robert W. Gauthier; Prithvi C. Lall

[57] ABSTRACT

A wideband, low-profile, towable submarine antenna is provided. The antenna is formed with a metal cylinder having a longitudinal slot. The entire antenna may be encapsulated in a tow body and towed horizontally on the surface of the water. The longitudinal slot is open at one end and closed, or shorted, at the opposite end. The location of the antenna feedpoint is placed along the slot so as to set up two sets of frequency resonances. This configuration provides two voltage standing wave ratio minimums, thereby extending the effective reception and transmission range over the entire military UHF frequency range (225–400 MHz).

14 Claims, 8 Drawing Sheets

WIDEBAND ANTENNA FOR TOWED LOW-PROFILE SUBMARINE BUOY

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates to antennas and more particularly to radiators for low-profile, towed submarine antennas.

(2) Description of the Prior Art

Present submarine communication and radio transmission and reception use surface antennas for a variety of requirements including military UHF band (225–400 MHz), LOS, SATCOM, etc. These requirements typically interfere with the covert operation of the submarine. For example, submarine UHF communication is accomplished by using wideband antennas within a mast, which must be extended whenever transmission or reception is required. For communications in coastal waters, raising a mast may compromise the ship's stealth. Furthermore, the current buoyant cable system (with a nominal diameter of 0.65 in.) cannot be used effectively for transmission at these frequencies, because of poor radiation efficiency.

There is a need for an antenna capable of efficient wideband communication while towed horizontally (in a suitably designed container with desirable hydrodynamic properties) in the ocean behind a submarine—a low-profile posture required in order to minimize or eliminate detectability. The term "wideband" is used here to describe an antenna whose input impedance (as described by the voltage standing wave ratio or VSWR) varies within acceptable limits (usually 3 or less) over a large portion (15% or more) of a band that by convention is wide. Moreover, throughout the frequency range of operation, the radiation pattern of the antenna must occupy hemispherical sectors of space above the sea surface that are bounded (roughly) by cones having large included angles in both the azimuth and elevation, to be useful.

SUMMARY OF THE INVENTION

It is an object of the invention to provide a low-profile, submarine buoy antenna which can operate while being towed or lying in a horizontal position on the surface of the water.

It is another object of the invention to provide a low-profile, submarine buoy antenna having efficient wideband coverage.

It is a further object of the invention to provide a low-profile, submarine buoy antenna having self-tuning features.

Accordingly, the invention is a wideband antenna for a low-profile, towed submarine buoy. The antenna is formed with a metal cylinder having a longitudinal slot. The longitudinal slot is open at one end and closed at the other end. The open-closed end configuration provides efficient broadband coverage without the need for tuning when the configuration is matched with a properly located antenna feedpoint. By setting the terminations, that is, the open end, the closed end, and the feedpoint (along with antenna diameter and thickness, and slot length and width), an antenna having a good impedance match over a wide frequency band is produced.

BRIEF DESCRIPTION OF THE DRAWINGS

The foregoing objects and other advantages of the present invention will be more fully understood from the following detailed description and reference to the appended drawings wherein corresponding reference characters indicate corresponding parts throughout the several views of the drawings and wherein.

DESCRIPTION OF THE PREFERRED EMBODIMENTS

Figure 1:
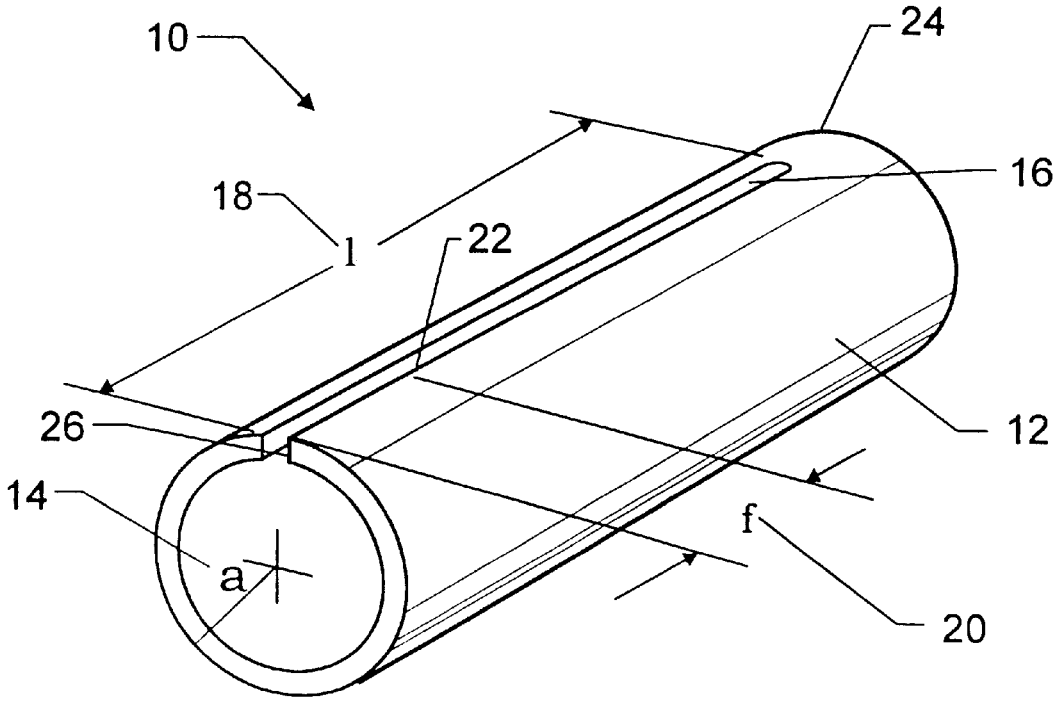
FIG. 1 is a perspective view of the wideband antenna of the invention showing the physical configuration.
Figure 2:
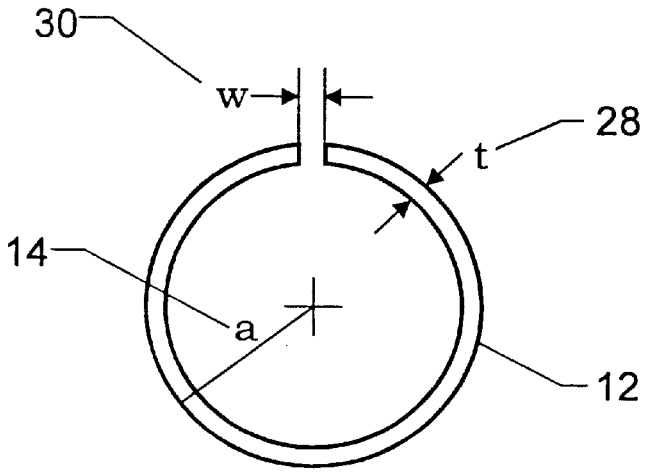
FIG. 2 is an end view of the wideband antenna showing the open end.

A view of the basic wideband antenna, designated generally by the reference numeral 10, is shown in FIGS. 1 and 2. The wideband antenna 10 comprises a metal cylindrical tube 12 having a radius a, 14, and having a longitudinal slot 16 running along the tube to a shorted end 24. The dimensions of the longitudinal slot 16, the slot length, l, 18, and other dimensions, including the tube radius, a, 14, wall thickness, t, 28 (shown in FIG. 2) and feedpoint location 22, as located by distance, f, 20, determine the antenna's bandwidth. Since the antenna operates over a large bandwidth, slot dimensions l, 18, and w, 30, are determined by two resonant frequencies $f_{r1}$ and $fr_{r2}$, corresponding to lengths l and l−f. The first resonant frequency is selected to occur near the top of the band of interest, while the second resonant frequency is selected to occur near the bottom of the band of interest.

The wideband impedance behavior of the antenna 10 is due to the manner in which the impedance contributions from the shorted end 24 and from the open end 26 combine at the feedpoint location 22. At the shorted end 24, the impedance is very small (ideally zero). The impedance is transformed to a different value at the feedpoint, in a manner analogous to the impedance transformation in an ordinary transmission line with a known impedance termination. Similarly, the open end 26, with a very large impedance (ideally infinite), is transformed to a different value at the feedpoint location 22. To a first approximation (neglecting antenna—transmission line interaction effects), the impedance "seen" at the feedpoint location 22 is the parallel combination of each transformed contribution.

Figure 3:
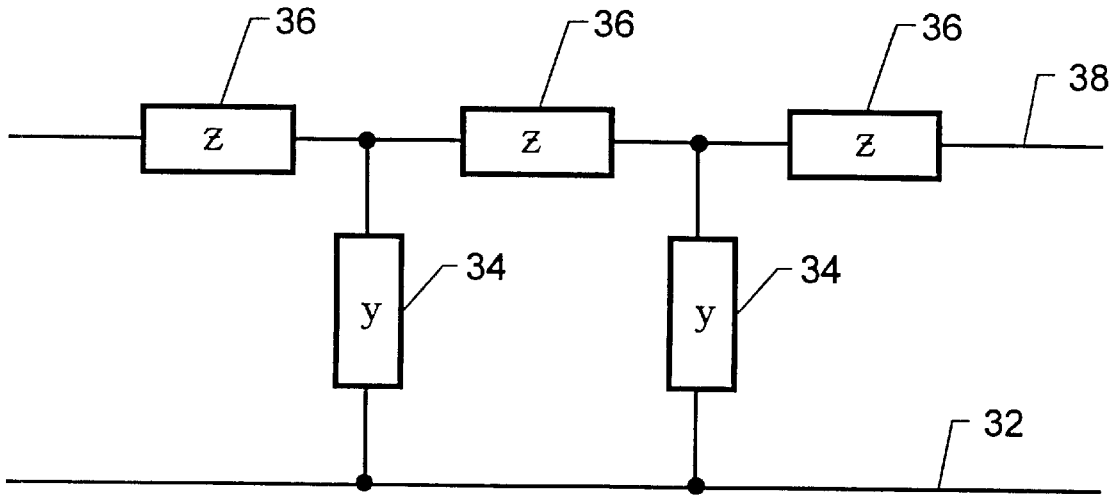
FIG. 3 is a schematic diagram showing a partial section of the equivalent circuit of the wideband antenna.

In the selected bandwidth, the antenna's electrical cross section is electrically small, such that $$\frac{a}{\lambda} \leq \frac{1}{8}, \tag{1}$$

where a is the antenna radius 14, and $\lambda$ is the free space wavelength. In the range of the selected bandwidth (where equation (1) applies), the antenna's input impedance can be described by an equivalent circuit comprising distributed constants, as shown in FIG. 3. The equivalent circuit has line 32 connected by parallel constants 34 to a series of constants 36 along line 38. The form of the equivalent circuit is analogous to that of a transmission line but departs from this similarity because the constants describe both the wave propagation along the slot 16 as well as the radiation properties in the far zone, away from the antenna 10. FIG. 3 depicts only a partial section of the infinitely long transmission lines 32, 38. It is noted that y and z in FIG. 3 denote the complex short admittance and series impedance per unit length, respectively, these quantities being functions of the antenna dimensions and frequency/wavelength.

As frequency varies, the transformed complex impedance from each end has associated with it a set of resonances (the frequencies where the reactance vanishes). The resonant frequencies from each termination, that is, the open end 26 and shorted end 24, arising from these transformations and "seen" at the feedpoint depend on the feedpoint location 22. This means that each "side" (i.e., the slot segment extending from short-to-feed or open-to-feed) has a set of resonant frequencies that depend on the length of each respective segment. By choosing an optimum feedpoint location along the slot, two of the resonances (one from each segment) can be staggered across the selected frequency band resulting in a combined parallel impedance match (and a low VSWR) over a wide frequency range.

Figure 4:
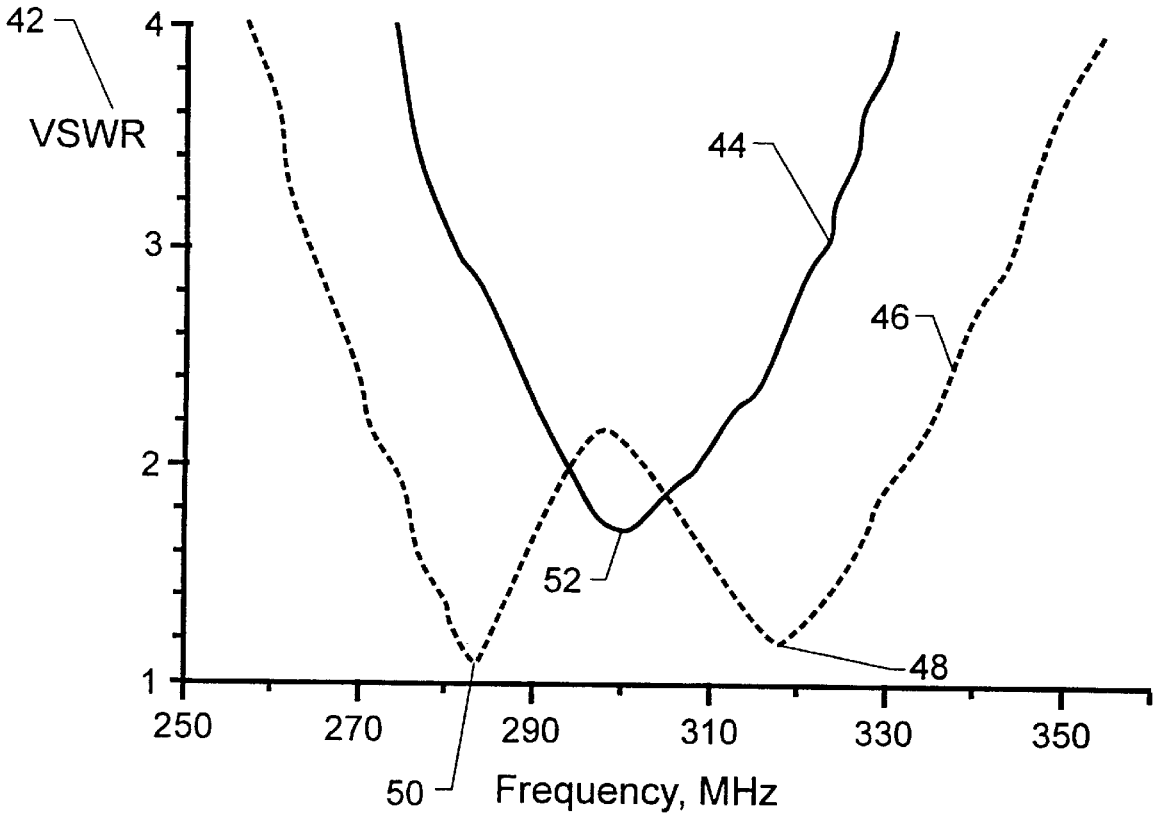
FIG. 4 is a graphical depiction comparing the performance of a slotted antenna having both ends closed with the open end antenna of the present invention.

Referring now to FIG. 4, a graphical comparison is provided showing the effect of the two resonances of this invention compared to an antenna having a single set of resonances. The input impedance of the antennas, as described by the voltage standing wave ratio (VSWR) 42, is plotted for both antennas, over a portion of the UHF spectrum from 250–350 MHz. Plot 44 shows the experimental results of a cylindrical antenna having a slot with both ends closed or shorted. As shown, the single set of resonances produced by the antenna having both ends shorted produces a single VSWR minimum 52. In comparison, the same antenna, shown by plot 46, having one end shorted and one end open (the antenna of this invention) has two sets of resonances and produces two VSWR minimums 50 and 48. The higher frequency VSWR minimum 48 is associated with the shorter slot segment, i.e., from feedpoint to the open end, while the lower frequency VSWR minimum 50 is associated with the longer slot segment to the shorted end.

From the brief description above, a manipulation of the terminations, i.e., the use of an open and a short at each end of the slot, as well as the other key dimensions (a, l, t, w), together with an optimum choice of feedpoint location (f), all contribute to an antenna capable of maintaining a good impedance match over a wide span of frequencies. The antenna dimensions for graph 46 of FIG. 4 were experimentally determined as follows:

a) $l \approx 0.715\ \lambda_s$: total slot length, a fraction of the wavelength in the slot, $\lambda_s$;

b) $k_c a \approx 0.386$: normalized cutoff wavenumber, where $k_c$ is the cutoff wavenumber; and c) $f \approx 0.253\ l$: feedpoint location from the open end to obtain a wideband impedance match. This relation holds for a 50 ohm coaxial transmission line.

It is to be understood that, although the foregoing dimensions have been found to be satisfactory, there may be other dimensions that can yield similar or improved results. The FIG. 4 plot of the measured VSWR of the wideband antenna, (compared to the same antenna with both ends shorted) indicates that the bandwidth for a VSWR of two or less for the new antenna is 20%, compared to 5% with both ends shorted. Furthermore, the radiation pattern as obtained from measurements is bounded within the cones 140° fore/aft and 170° athwart. A depiction of the radiation patterns in both air and on the sea surface is shown in FIGS. 5*a*, 5*b*, 6*a* and 6*b*.

Figure 5A:
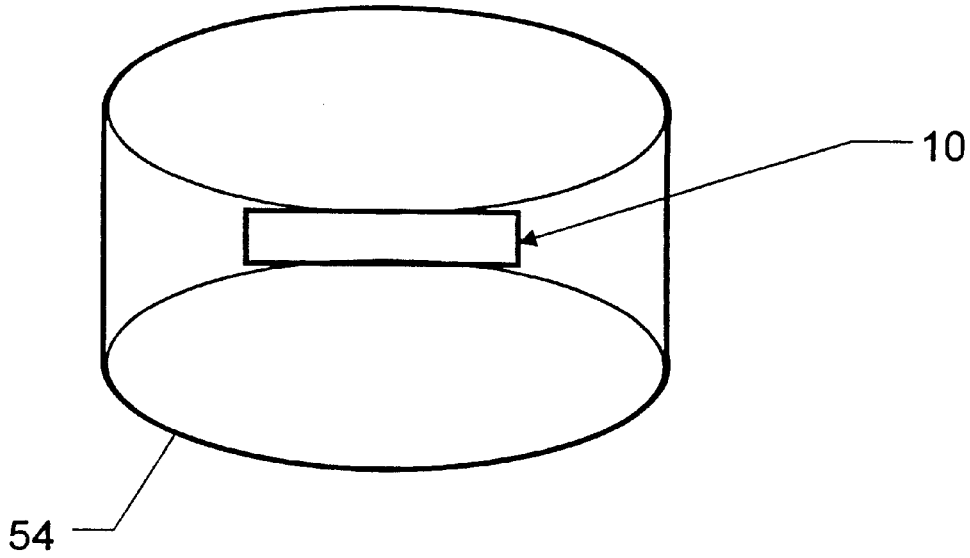
FIG. 5*a* is a side elevational view depicting the toroidal propagation around the wideband antenna.
Figure 5B:
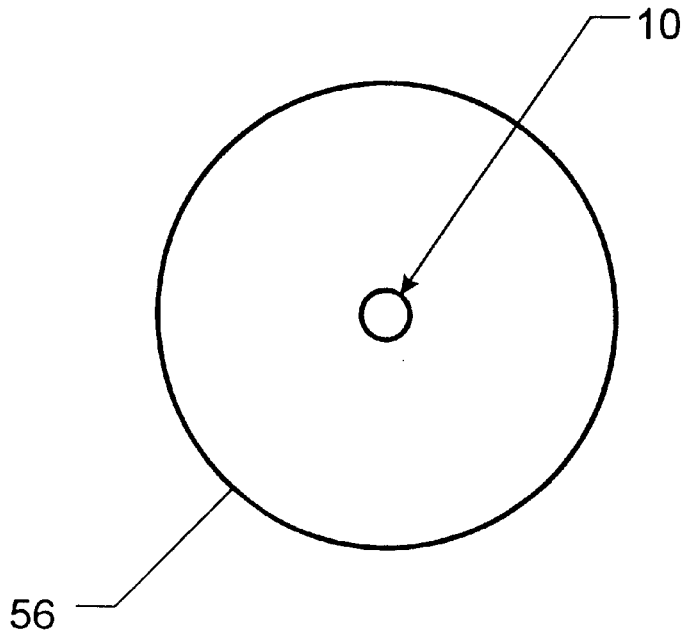
FIG. 5*b* is an end-on view of the wideband antenna showing the propagation pattern as viewed from the end of the antenna.
Figure 6A:
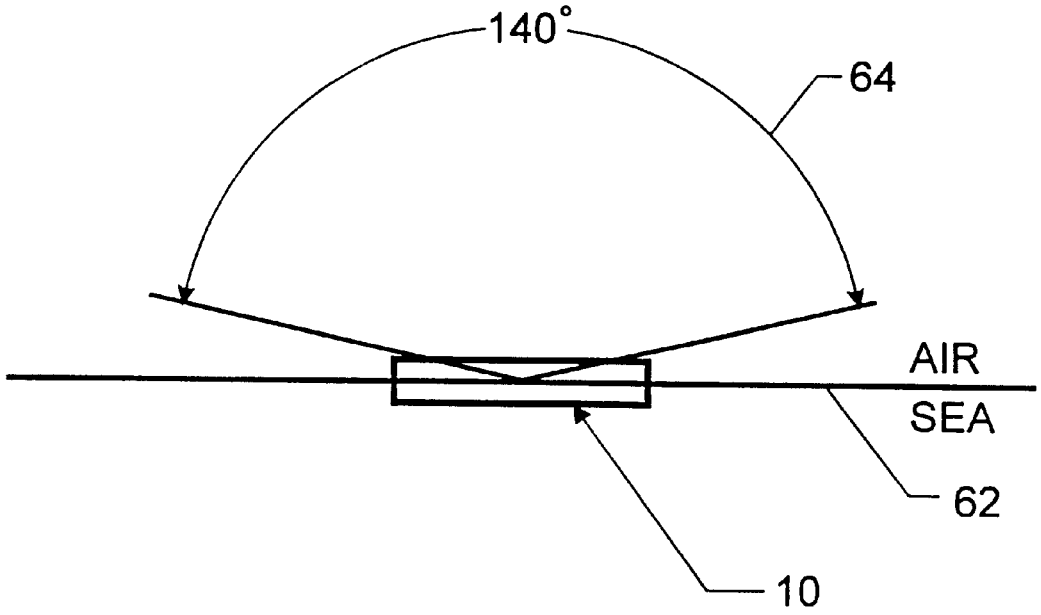
FIG. 6*a* is a side view of the wideband antenna floating (or being towed) on the water surface providing a radiation pattern of 140° fore and aft.
Figure 6B:
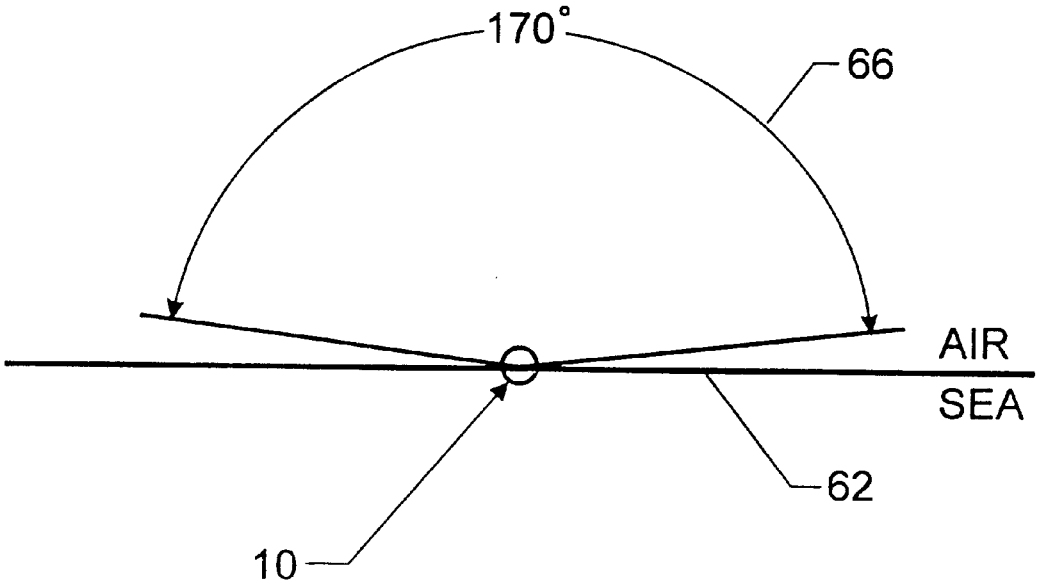
FIG. 6*b* is an end view of the wideband antenna providing an athwart radiation pattern of 170° side-to-side.

FIGS. 5*a* and 5*b* are representations of the antenna radiation patterns in air. FIG. 5*a* is a side elevation view depicting the toroidal propagation 54 around the wideband antenna 10. FIG. 5*b* is an end-on view of the wideband antenna 10 showing the propagation pattern 56 as viewed from the end of the antenna 10. FIGS. 6*a* and 6*b* are representations of the antenna radiation pattern with the antenna located on the surface of the ocean. FIG. 6*a* is a side view of wideband antenna 10 floating (or being towed) on the water surface 62 providing a radiation pattern 64 of 140° fore and aft. FIG. 6*b* is an end view of the wideband antenna 10 providing an athwart radiation pattern 66 of 170° side-to-side.

The particular form of the dimensions herein is further amplified hereafter. The manipulation of antenna dimensions a, l, t, w and feed position f affect the equivalent circuit in such a manner as to yield wideband operation. The primary effect of the dimensional changes is on the wave propagation characteristics in the slot region. This effect may be described by two quantities, namely, the cutoff frequency ($f_c$) and the propagation constant ($\beta$), which depend primarily on the antenna cross section and to a much smaller extent on the end terminations.

The cutoff frequency, $f_c$, is the frequency where the wave-like distribution of voltage and current in the slot region becomes evanescent. Under normal operation (i.e., above cutoff), the voltage and current distribution along the slot varies sinusoidally, exciting a similar distribution around the antenna circumference, thereby creating the radiation field. At the cutoff frequency, however, this action is essentially extinguished and is characterized by exponentially decaying amplitudes in both distributions; the maximum value of these waves being in the immediate vicinity of the feedpoint.

The cutoff wavenumber, $k_c$ (in meter$^{-1}$), is related to $f_c$ (in Hz) through $$k_c = \frac{2\pi f_c}{v}, \tag{2}$$

where v is the speed of light in a vacuum, approximately $3\times10^8$ meters/sec. The normalized cutoff wavenumber, $k_c a$, is unitless.

The propagation constant, $\beta$ is an indirect measure of the wavelength in the slot region, $\lambda_s$, which is greater than or equal to the wavelength of free space, $\lambda$. The value of $\lambda_s$ is related to $\beta$ through the relation $$\lambda_s = \frac{2\pi}{\beta}. \tag{3}$$

The antenna dimensions expressed earlier are therefore disclosed generally allowing selection of the absolute values of a, l, t and w, for fabrication of a practical antenna. This antenna may be considered unique because its design requires several transmission line parameters to be simultaneously satisfied. Other antennas, in contrast, require only a knowledge of the free space wavelength to compute its absolute dimensions.

Consistent with the equivalent circuit, useful approximations for $k_c a$ and $\beta$ have been derived by assuming a slotted tube of infinite length and are presented here to facilitate the determination of antenna dimensions. The approximations for $k_c a$ and $\beta$ are accurate to within 4% and 6%, respectively, permitting a good estimate of the antenna size required for use at other frequency ranges of interest. The dimensions derived through use of the expressions are then refined empirically. Normalized cutoff wavenumber, $k_c a$ is determined by $$k_c a \approx \frac{\sqrt{1+10\zeta}-1}{\zeta}, \tag{4}$$

where $$\zeta = 1 + 10\left[\pi\left(\frac{t}{w}\right) + \left(\frac{\varphi_o}{6}\right)^2 + 2(1-\ln\varphi_o)\right] \tag{5}$$

and $$\varphi_o = 2\sin^{-1}\left(\frac{w}{2a}\right). \tag{6}$$

The expression for $k_c a$ is valid for $\phi_o \leqq 36°$.

Propagation constant, $\beta$ is determined by $$\beta \approx \kappa_1 F_1 + \kappa_2 \mathrm{Re}(F_2), \tag{7}$$

where $$F_1 = \sqrt{\frac{x\left(b+\sqrt{b^2+g^2}\right)}{2}}, \tag{8}$$

$$F_2 = \sqrt{k^2 - \left(\frac{5-ka}{5-k_c a}\right)k_c^2}, \tag{9}$$

k is the operating frequency and the quantities b, g, x, $\kappa_1$, $\kappa_2$ used in $F_1$ are defined in Table I, noting that $\eta$ is the intrinsic wave impedance, $\eta$=120 $\pi$ohms.

TABLE I

Values of Constants used in Expression $F_1$

| Symbol | Name | Units | Approximate Expression |
|---|---|---|---|
| x | Distributed slot Series reactance | Ohms/meter | $x \approx \frac{5\pi k\eta (k_c a)^2}{5-k_c a}$ |
| g | Distributed slot shunt conductance | Siemens/meter | $g \approx \frac{1}{240\lambda}\left[\frac{1+16(ka)^4}{1+10(ka)^4}\right]$ |
| b | Distributed slot shunt susceptance | Siemens/meter | $b \approx \frac{\frac{1}{5}\left\{1+\left[\frac{ka(5-k_c a)}{(k_c a)^2}\right]\right\} - \frac{1}{ka}}{\pi\eta a}$ |
| $\kappa_1$ | Constant | . . . | $\kappa_1 \approx \frac{25}{26}$ |
| $\kappa_2$ | Constant | . . . | $\kappa_2 \approx \frac{1}{26} + \frac{(k_c a)^2}{30} - \frac{(k_c a)^3}{13} - \frac{(k_c a)^4}{3}$ |

The following example illustrates the method for sizing an antenna. Using a center cutoff frequency of 1 Ghz, an antenna diameter of 3.0 inches and a wall thickness of 0.05 inch, the slot length and slot width can be determined from an application of the foregoing equations.

Given that $k_c a \approx 0.386$, a trial and error solution for the slot width, w=0.26 inch, is determined from equations (4), (5) and (6). Values for $F_1$ and $F_2$ are determined from equations (8) and (9), respectively, using the formulas in Table I. Equation (7) is then used to determine $\beta$. This value is used in equation (3) to determine $\lambda_s$, and finally the slot length l, is determined to be 6.32 inches from the relationship $l \approx 0.715\ \lambda_s$.

The antenna can be built in many ways, i.e., a large number of embodiments are possible, so long as the experimental dimensions $k_c a$, l and f are not seriously violated. Some possible structures are shown in FIGS. 7*a*, 7*b*, 8*a*, 8*b*, 9*a* and 9*b*.

Figure 7A:
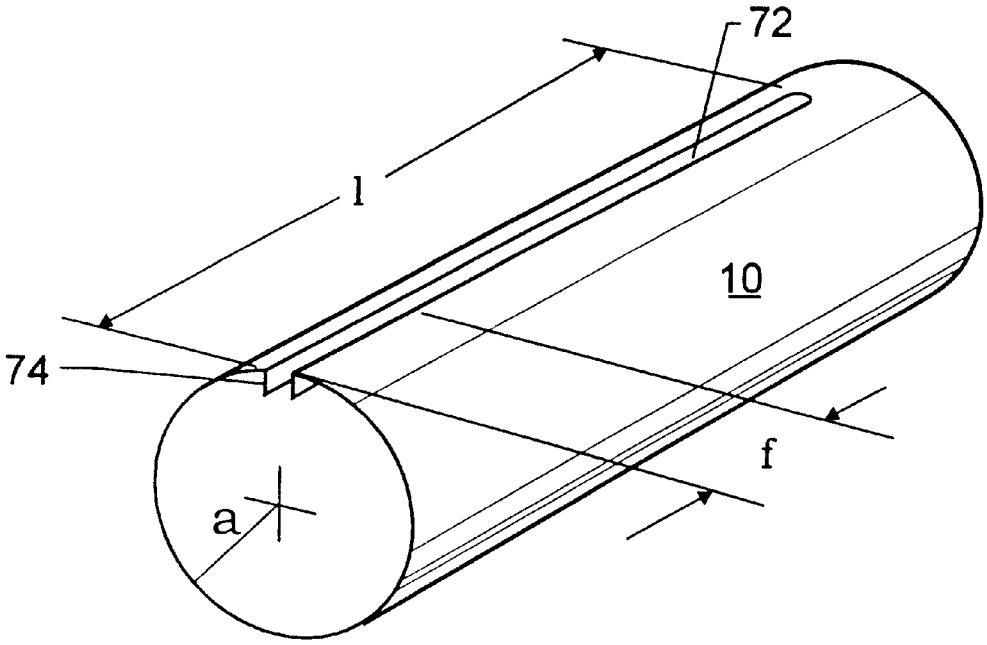
FIG. 7*a* is a perspective view of a thin-walled embodiment of the present invention.
Figure 7B:
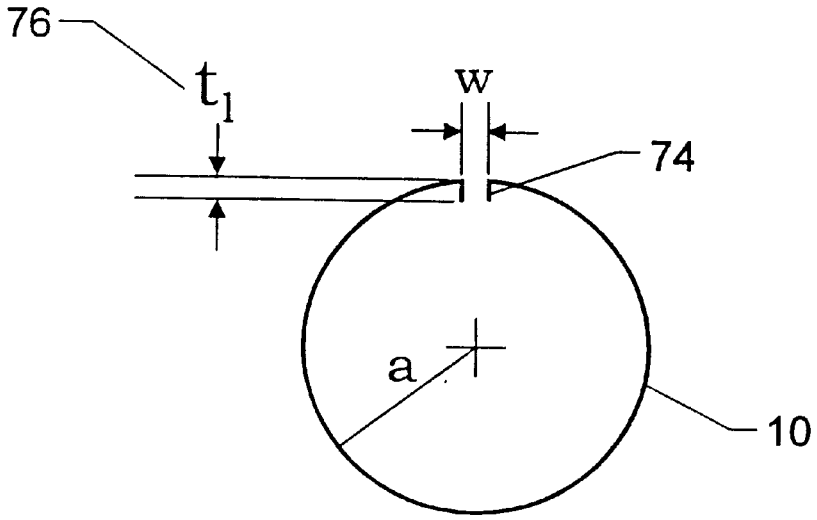
FIG. 7*b* is an end view of the thin-walled embodiment of the present invention.

Referring now to FIGS. 7*a* and 7*b*, the wideband antenna's slot region 72 is modified with a small metal "lip" 74 that runs the entire slot length, including the shorted end. If a slender antenna 10 is required, the lip 74 helps to maintain the design equality, $k_c a$=0.386, by a careful selection of lip depth $t_1$, 76 and substituting $t_1$, for t in equation (5). However, some bandwidth may be lost with this method.

Figure 8A:
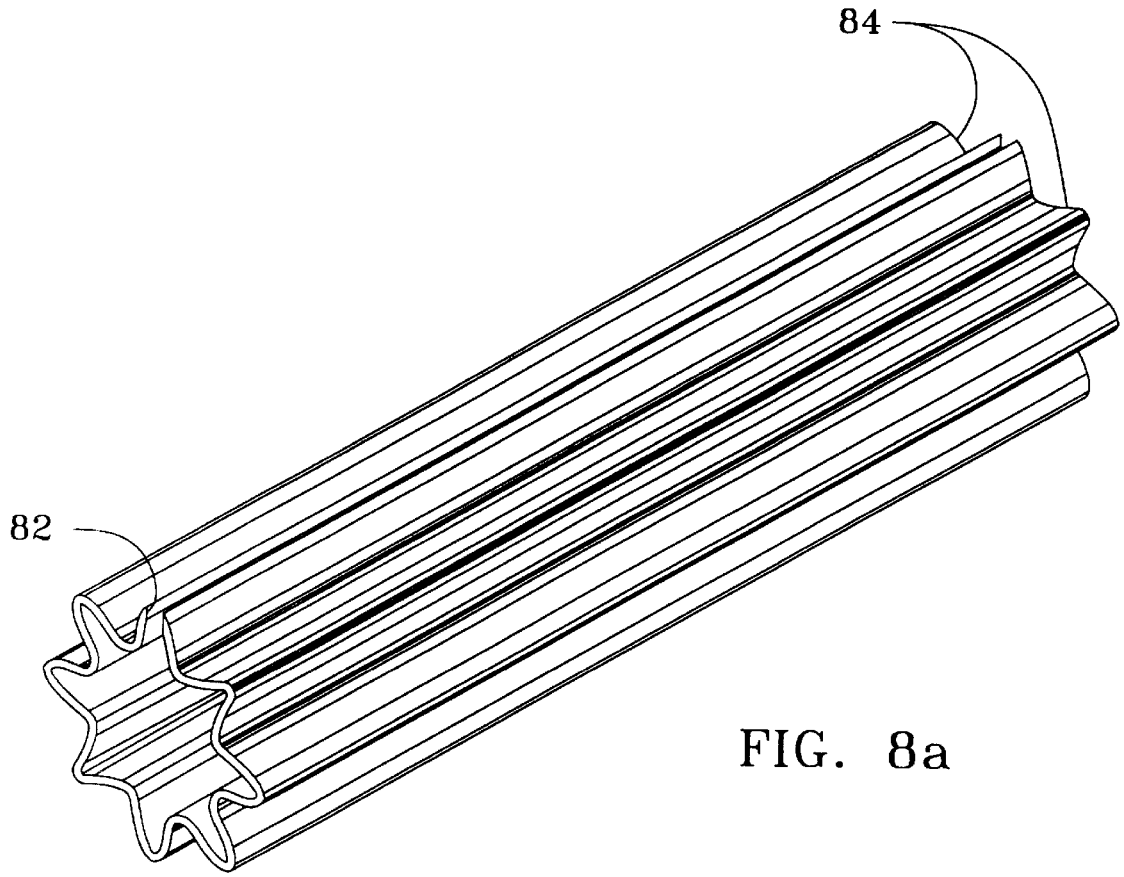
FIG. 8*a* is a perspective view of a corrugated cylinder embodiment of the present invention.
Figure 8B:
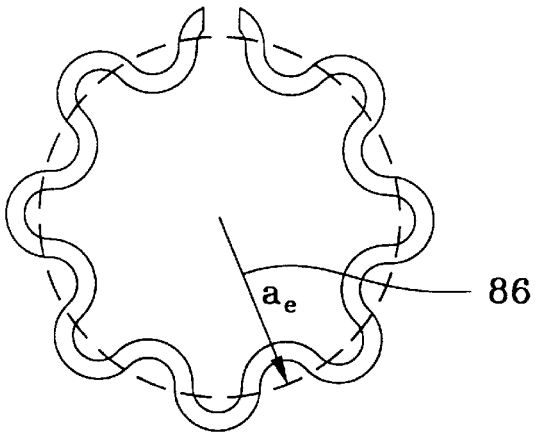
FIG. 8*b* is an end view of the corrugated cylinder embodiment of the present invention.

The same effect, shown in FIGS. 8*a* and 8*b*, can be accomplished with a corrugated cylinder having a slot 82. Here, the cylinder cross section is contorted to accommodate a constraint in the radius. By a careful selection of the periodicity and depth of undulations 84 in the circumferential direction, the antenna may maintain its wideband behavior. For purposes of computation, the effective radius $a_e$, 86, of the antenna is estimated by application of the following expression:

$$a_e \approx \frac{1}{2}\left[\sqrt{\frac{A}{\pi}} + \frac{P}{2\pi}\right], \tag{10}$$

where A and P denote the antenna's cross sectional area and peripheral surface, respectively. The value of $a_e$ is substituted for a in the sizing formulae.

Figure 9A:
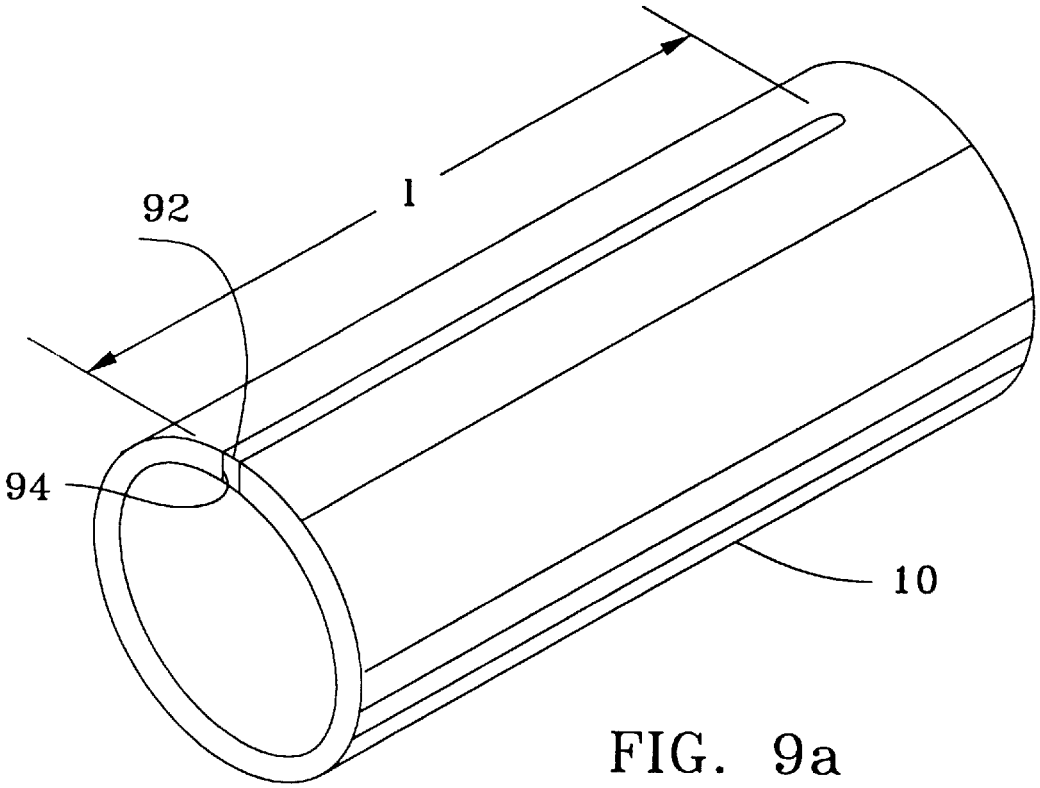
FIG. 9*a* is a perspective view of the wideband antenna having a dielectric material in the cylinder slot.
Figure 9B:
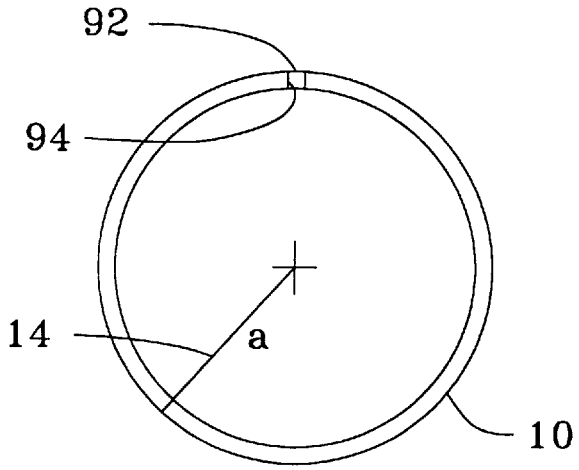
FIG. 9*b* is an end view of the wideband antenna having a dielectric material in the cylinder slot.

In FIGS. 9*a* and 9*b*, the antenna radius, a, 14, and slot length l, 18, is reduced by introducing a dielectric window 92 into the slot region 94. This method can decrease the impedance bandwidth, however. Through careful selection of dielectric constant and other geometric factors, however, the bandwidth can be tailored to be between 5% and 20% for a specific application.

Possible applications of this method would be:

a) Transmit/Receive antenna pair for low-profile towed buoy. Here, two antennas, each with a 2:1 VSWR bandwidth of 12% can be used to cover the 240–270 MHz and 290–320 MHz band without the need for tuning. The two frequency ranges are used for satellite reception and transmission, respectively.

b) Desensitizing for under-the-ice communications. If an antenna is required to operate under the ice with no perceptible detuning, an appropriately chosen dielectric window material can be chosen. The resulting insensitivity to the proximity of sea ice over the slot region is brought about because the phase velocities of the slot and ice regions are approximately equal. Using this observation as a guide, an approximate value for the dielectric constant in the slot region can be estimated with the following expression:

$$\varepsilon_{r,slot} \approx \frac{\varepsilon_{r,ice}}{1-\left(\frac{k_c}{k}\right)^2}, \tag{11}$$

where $k_c$ and k denote the wavenumbers corresponding to the antenna's cutoff and operating frequency, respectively. If the antenna is operating high above cutoff, then $k \gg k_c$, and $\epsilon_{r,slot} \approx \epsilon_{r,ice}$. Aside from the geometrical effects mentioned earlier, the antenna's proximity to seawater (below the sea ice) must also be considered in order to arrive at a compromise value of $\epsilon_{r,slot}$.

The advantages and new features of the invention are numerous. The wideband antenna of this invention provides a low-profile antenna, which may be towed in the horizontal position thereby minimizing detectability by hostile forces and which requires no tuning to receive and transmit over a wide bandwidth. The invention allows the reception of multiple signals simultaneously, thereby covering numerous requirements, such as voice transmissions, SATNAV, etc.

The novel combination of the slot length, feed point location and other antenna parameters provide the following:

a) Spread spectrum communications. The wideband antenna finds ready application for this kind of work. Within the limits outlined earlier, the antenna, along with the requisite electronics can quickly scan a frequency range, ensuring secure communications or function in an anti-jam scenario.

b) Threat detection. Currently, there is no antenna in use that is low-profile and capable of detecting radar or other electromagnetic threats. The present antenna, due to its wideband behavior can be used alone or with a plurality of other similar antennas (scaled to different center frequencies with some overlap), to survey such threats.

c) Under-the-ice communications. The present antenna, encased in a buoy, may be released by a submerged submarine under icy regions. The antenna floats upward toward the ice, and once firmly fixed under a relatively flat ice layer, is activated to establish a satellite link. It is important to note that the slot region, and a small angular sector from it, must be facing the ice in order to operate properly. Properly executed, the antenna may permit emergency or other links necessary to complete a mission.

d) Cellular/PCS communications. The present wideband antenna can be stacked to form a collinear array to increase power gain. A plurality of these collinear arrays may be installed on a cellular tower to provide high gain, omni-azimuthal coverage (in the horizontal plane) over the cellular or PCS bands (800–1000 MHz, 1700–2200 MHz).

e) Simplicity of construction. The antenna's construction is simple and economical. Other requirements, such as structural strength, can be addressed through appropriate choice of metals or structural components internal to the antenna, to offset the large hydrostatic pressure it may encounter while in service (e.g., when deployed at large depths).

f) Simple excitation. A single 50 ohm coaxial cable is required to apply RF energy to the antenna.

g) Wideband impedance match. The fractional bandwidth $$BW = \frac{f_{\max} - f_{\min}}{f_o}, \tag{12}$$

where $$f_o = \sqrt{f_{\min} \cdot f_{\max}}, \tag{13}$$

over which the antenna exhibits a VSWR of two or less has been determined to be 20%.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A wideband antenna for a towed, low-profile submarine buoy comprising:

a tube having a longitudinal slot extending a length l along the surface of the tube, such slot having a first open end and a second, shorted end; and an antenna feedpoint located along the longitudinal slot in said tube between the open end and the shorted end such that two distinct sets of resonant frequencies occur between the feedpoint and the ends of the slot.

2. A wideband antenna for a towed, low-profile submarine buoy as in claim 1 wherein said tube is cylindrical.

3. A wideband antenna for a towed, low-profile submarine buoy as in claim 2 wherein said cylindrical tube has a radius a, a wall thickness t and a slot width w so as to provide a normalized cutoff wavenumber, $k_c a$, approximately equal to $$\frac{\sqrt{1+10\zeta}-1}{\zeta},$$

where $$\zeta = 1 + 10\left[\pi\left(\frac{t}{w}\right) + \left(\frac{\varphi_o}{6}\right)^2 + 2(1-\ln\varphi_o)\right] \text{ and } \varphi_o = 2\sin^{-1}\left(\frac{w}{2a}\right).$$

4. A wideband antenna for a towed, low-profile submarine buoy as in claim 3 wherein said normalized cutoff wavenumber is equal to 0.386±4%.

5. A wideband antenna for a towed, low-profile submarine buoy as in claim 2 wherein said cylindrical tube has a slot length proportional to a frequency propagation constant, $\lambda_s$.

6. A wideband antenna for a towed, low-profile submarine buoy as in claim 5 wherein the frequency propagation constant, $\lambda_s$, is inversely proportional to a propagation constant β, such constant β being proportional to the square root of a product of a distributed slot series reactance and a distributed slot shunt susceptance, b, combined with the square root of the summation of the squares of the distributed slot shunt susceptance, b, and the distributed slot shunt conductance, g, that is $$\lambda_s = \frac{2\pi}{\beta},$$

where $$\beta = \kappa_1\sqrt{\frac{x\left(b+\sqrt{b^2+g^2}\right)}{2}} + \kappa_2\mathrm{Re}\sqrt{k^2-\left(\frac{5-ka}{5-k_ca}\right)k_c^2}.$$

7. A wideband antenna for a towed, low-profile submarine buoy as in claim 6 wherein the slot length is 0.715 $\lambda_s$±6%.

8. A wideband antenna for a towed, low-profile submarine buoy as in claim 1 wherein said antenna feedpoint is located 0.253 l±6% along the slot from the open end.

9. A wideband antenna for a towed, low-profile submarine buoy as in claim 1 wherein said tube is a corrugated cylinder.

10. A wideband antenna for a towed, low-profile submarine buoy as in claim 1 wherein the slot in said tube is filled with a dielectric material.

11. A wideband antenna for a towed, low-profile submarine buoy as in claim 10 wherein the dielectric material has a phase velocity approximately equal to ice.

12. A wideband antenna for a towed, low-profile submarine buoy as in claim 1 wherein said tube is a thin-walled tube having a lip along the longitudinal slot, such lip dimensioned to maintain the design equality, $\kappa_c a \approx 0.386$.

13. A method for setting parameters for a wideband cylindrical, slotted antenna for a towed, low-profile buoy comprising:

determining the cutoff wavenumber, $$k_c = \frac{2\pi f_c}{v},$$

where $f_c$ is a chosen cutoff frequency of the antenna and v is speed of light in a vacuum;

determining the normalized cutoff wavenumber, $$k_ca \approx \frac{\sqrt{1+10\zeta}-1}{\zeta},$$

using the relationships $$\zeta = 1+10\left[\pi\left(\frac{t}{w}\right)+\left(\frac{\varphi_o}{6}\right)^2+2(1-\ln\varphi_o)\right] \text{ and } \varphi_o = 2\sin^{-1}\left(\frac{w}{2a}\right),$$

where a is a chosen radius of the antenna, t is a chosen wall thickness of the antenna and w is a chosen width of a slot of the antenna;

determining a propagation constant $$\beta \approx \kappa_1 F_1 + \kappa_2\mathrm{Re}(F_2),$$

using the relationships $$F_1 = \sqrt{\frac{x\left(b+\sqrt{b^2+g^2}\right)}{2}}$$

and $$F_2 = \sqrt{k^2-\left(\frac{5-ka}{5-k_ca}\right)k_c^2},$$

where $$\kappa_1 \approx \frac{25}{26},$$

$$\kappa_2 \approx \frac{1}{26}+\frac{(k_ca)^2}{30}-\frac{(k_ca)^3}{13}-\frac{(k_ca)^4}{3},$$

$$x \approx \frac{5\pi k\eta(k_ca)^2}{5-k_ca},$$

k is a chosen operating frequency of the antenna, η is the intrinsic wave impedance=120 πohms, $$b \approx \frac{\frac{1}{5}\left\{1+\left[\frac{ka(5-k_ca)}{(k_ca)^2}\right]\right\}-\frac{1}{ka}}{\pi\eta a}$$

and is a distributed slot shunt susceptance of the antenna, $$g \approx \frac{1}{240\lambda}\left[\frac{1+16(ka)^4}{1+10(ka)^4}\right]$$

and is a distributed slot shunt conductance of the antenna and λ is a free space wavelength;

determining a slot wavelength $$\lambda_s = \frac{2\pi}{\beta};$$

and iteratively adjusting the chosen parameters to obtain the desired wideband operation.

14. A method for determining dimensions for a wideband antenna for a towed, low-profile buoy comprising the steps of:

choosing values for a center cutoff frequency $f_0$, an antenna diameter a and an antenna wall thickness t;

obtaining a slot width w using trial and error solutions for the relationships $$k_ca \approx \frac{\sqrt{1+10\zeta}-1}{\zeta},$$

$$\zeta = 1 + 10\left[\pi\left(\frac{t}{w}\right) + \left(\frac{\varphi_o}{6}\right)^2 + 2(1 - \ln\varphi_o)\right] \text{ and } \varphi_o = 2\sin^{-1}\left(\frac{w}{2a}\right),$$

where $k_c a \approx 0.386$;

determining a propagation constant β, where $$\beta \approx \kappa_1 F_1 + \kappa_2 \mathrm{Re}(F_2),$$

$$F_1 = \sqrt{\frac{x\left(b + \sqrt{b^2 + g^2}\right)}{2}},$$

$$F_2 = \sqrt{k^2 - \left(\frac{5 - ka}{5 - k_c a}\right)k_c^2},$$

$$x \approx \frac{5\pi k\eta(k_c a)^2}{5 - k_c a},$$

$$g \approx \frac{1}{240\lambda}\left[\frac{1 + 16(ka)^4}{1 + 10(ka)^4}\right],$$

$$b \approx \frac{\frac{1}{5}\left\{1 + \left[\frac{ka(5 - k_c a)}{(k_c a)^2}\right]\right\} - \frac{1}{ka}}{\pi\eta a},$$

-continued $$\kappa_1 \approx \frac{25}{26}$$

and $$\kappa_2 \approx \frac{1}{26} + \frac{(k_c a)^2}{30} - \frac{(k_c a)^3}{13} - \frac{(k_c a)^4}{3};$$

determining a slot wavelength $\lambda_s$, where $$\lambda_s = \frac{2\pi}{\beta};$$

and determining a slot length from the relationship $l \approx 0.715\,\lambda_s$.

* * * * *